United States Patent [19]

Kotcharian

[11] 4,128,069

[45] Dec. 5, 1978

[54] METHOD OF MOUNTING A HEAT-INSULATING COMPOSITE WALL STRUCTURE IN A LIQUEFIED GAS TRANSPORTATION AND/OR STORAGE TANK

[75] Inventor: Michel Kotcharian, Paris, France

[73] Assignee: Technigaz, France

[21] Appl. No.: 819,599

[22] Filed: Jul. 27, 1977

[30] Foreign Application Priority Data

Aug. 10, 1976 [FR] France ..... 76 24415

[51] Int. Cl.[2] ..... B63B 25/08

[52] U.S. Cl. ..... 114/74 A; 220/901

[58] Field of Search ..... 220/9 R, 9 LG, 10, 15; 114/74 R, 74 A

[56] References Cited

U.S. PATENT DOCUMENTS

| | | | |
|---|---|---|---|
| 3,112,043 | 11/1963 | Tucker | 220/15 |
| 3,367,492 | 2/1968 | Pratt | 114/74 A |
| 3,929,247 | 12/1975 | Borup | 114/74 A |

*Primary Examiner*—Trygve M. Blix
*Assistant Examiner*—D. W. Keen
*Attorney, Agent, or Firm*—Steinberg & Blake

[57] ABSTRACT

A method of mounting a composite heat-insulating wall structure for a tank for the transportation of liquefied gases, wherein a wall of heat-insulating material is injected directly onto the secondary barrier formed by the ship's double hull, the primary barrier being secured on the insulating wall. This insulating wall is injected through the medium of moulds.

12 Claims, 8 Drawing Figures

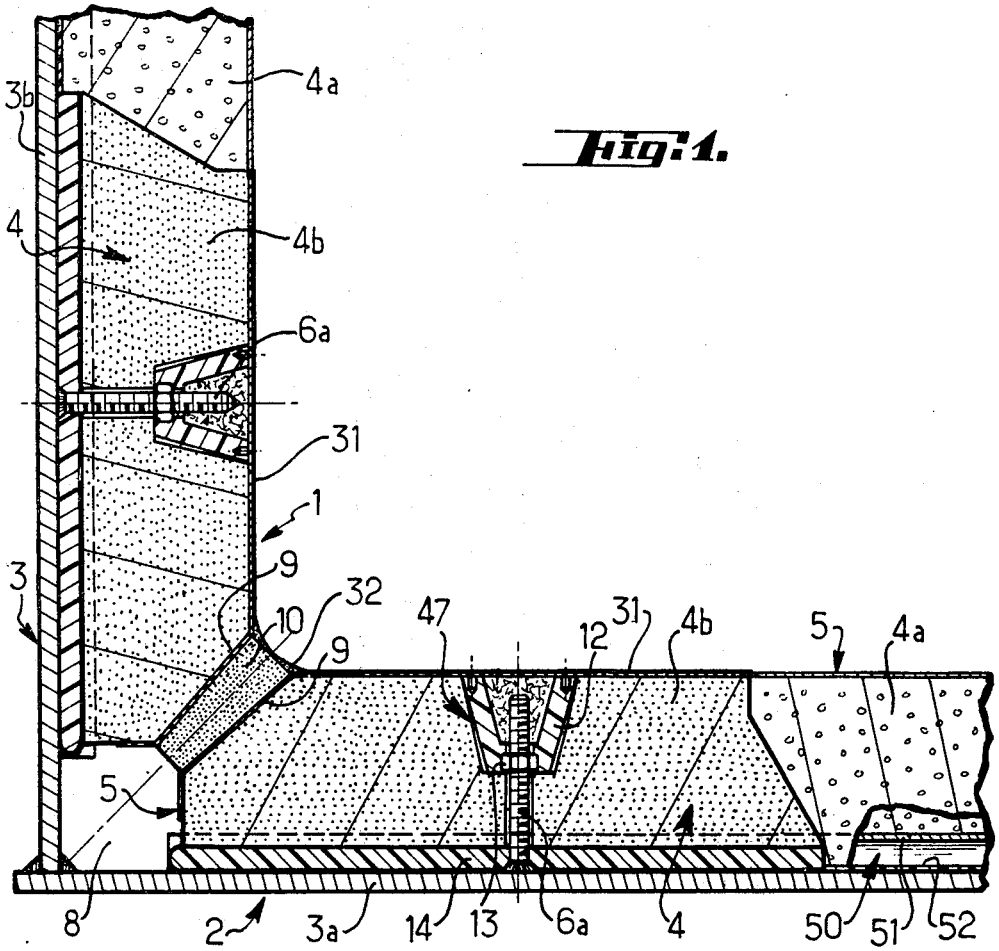
Fig: 1.
Fig: 8.
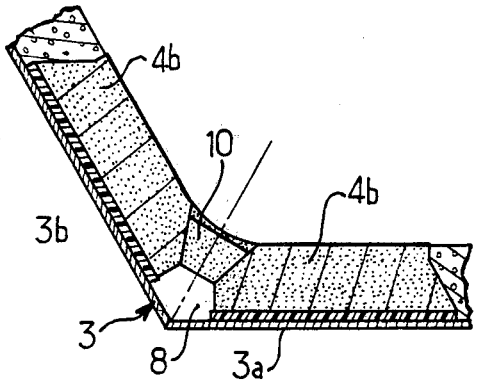
Fig: 7.
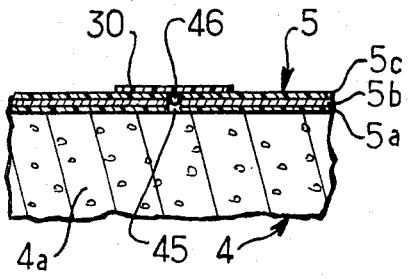

METHOD OF MOUNTING A HEAT-INSULATING COMPOSITE WALL STRUCTURE IN A LIQUEFIED GAS TRANSPORTATION AND/OR STORAGE TANK

The present invention has for its object a method of mounting a heat-insulating wall structure for a tank, receptacle, container or like enclosed space for the transportation and/or storage of liquefied gases and more particularly for a built-in, integrated or incorporated tank in the case of sea transportation of liquefied petroleum gases.

There have already been proposed several heat-insulating structures for the walls of tanks intended for the transportation and/or storage of liquefied natural gases which may reach temperatures ranging about −150° C. Such walls are relatively complex and therefore expensive. On the contrary, for the transportation and/or storage of liquefied petroleum gases having temperatures of the order of −50° C., simpler wall structures can be designed, since they must offer less stringent characteristics.

A wall structure of a known type for the transportation of liquefied petroleum gases is made up, from the inside towards the outside:

of a fluid-tight membrane or primary barrier directly in contact with the liquid, of a carrying insulation of a cellular material such as polyurethane foam, of a secondary barrier simply constituted by the double hull of the ship in the case of a built-in tank.

In order to put in place such a structure, more particularly the carrying insulation thereof, polyurethane panels are prefabricated and then applied on and secured to the secondary barrier, with interposition of joints between the panels.

This carrying insulation placing procedure suffers from several disadvantages, more particularly that of the discontinuity of the carrying insulation owing to the presence of joints between the panels, which are particularly vulnerable to thermal shocks. Moreover, there arise all the problems relating to the adherence of the insulation to the secondary steel barrier.

The purpose of the invention is to eliminate such drawbacks by providing a method of mounting a heat-insulating wall structure wherein the carrying insulation is directly applied on and secured to the secondary barrier by injecting polyurethane foam into removable moulds attached to the secondary barrier. This method of placing the carrying insulation allows a continuous insulating layer, without interposed joints, to be obtained. Moreover, the said method allows a better adherence of the insulation to the secondary barrier to be ensured.

The invention therefore has for its object a method of mounting a heat-insulating composite wall structure for a tank or container for the transportation and/or storage of, for example, liquefied gases, more particularly for sea transportation of liquefied petroleum gases in built-in, integrated or incorporated tanks, comprising a rigid outer wall constituted by the double hull of the ship forming a secondary barrier, a wall of heat-insulating material such as rigid polyurethane foam injected directly on the secondary barrier, and an inner, substantially flexible wall or fluid-tight membrane forming a primary barrier secured on the said insulating wall.

According to another characteristic feature of the method of the invention, the wall structure comprises a series of stiffening blocks of predetermined length extending in longitudinal relationship to the straight angle-edge line of each dihedral angle of the tank in proximity to the ends of its two adjacent internal faces defining the said dihedral angle, the continuity of the two rows of stiffening blocks on either side of the dihedral angle edge being obtained by means of a set of shims mounted between the adjacent edges of the two rows of stiffening blocks.

According to another characteristic feature of the method of the invention, the said stiffening blocks, which therefore constitute the insulating wall in the regions of the dihedral angles of the tank, are preferably constituted by rigid polyurethane foam of higher density than the one injected directly onto the secondary barrier to constitute the rest of the insulating wall.

According to another characteristic feature of the method of the invention, the shape of the stiffening blocks is independent of the value of the dihedral angles, only the shape of the shims ensuring the continuity between two adjacent rows of stiffening blocks being different.

According to another characteristic feature of the method of the invention, a device is provided for continually checking the fluid-tightness of the primary barrier through the medium of a system of drain conduits located at the interface between the insulation and the secondary barrier and for locating any water ingress which may occur as a result of cracks in the double hull.

According to another characteristic feature of the method of the invention, a device is provided at the butt-straps or joint-plates of the primary barrier, allowing any leakage which may occur at a butt-strap or joint-plate which has just been mounted to be detected practically instantaneously.

Other advantages, characteristic features and details of the invention will appear more clearly from the following explanatory description with reference to the appended drawings given solely by way of example and wherein:

FIG. 1 is a partially sectional view through a 90-deg dihedral angle of a built-in tank, illustrating a preferred form of embodiment of a wall structure utilized in a method according to the invention;

FIG. 7 is a sectional view upon the line VII—VII of FIG. 2, showing the device for detecting the leaks at the butt-straps of the primary barrier; and FIG. 8 is a partial sectional view of the wall structure used in the method of the invention in the region of a dihedral angle greater than 90°.

Figure 2:
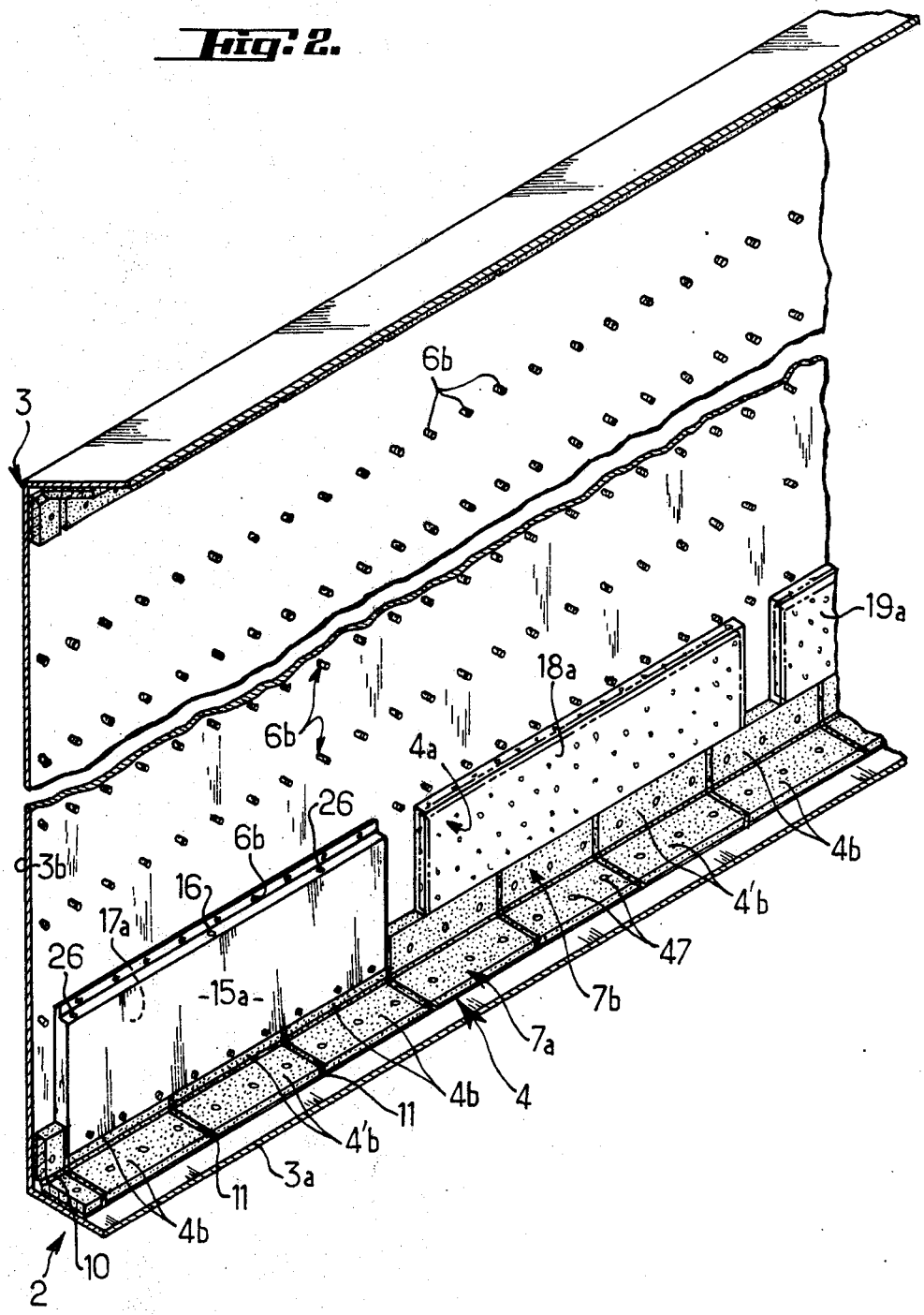
FIG. 2 is a partial perspective view of a tank fragment illustrating the first stage of the method of mounting the wall structure according to the invention.

The invention therefore relates to a method of mounting a wall structure 1 for a tank 2 of the built-in, integrated or incorporated type for the transportation and/or the storage of liquefied petroleum gases at a temperature ranging about −50° C., which, as appears in FIGS. 1 and 7, is made up of:

a secondary barrier 3 constituted by the ship's double hull of steel possessing impact resistance at −50° C., a carrying insulation 4 which must stand up well to cyclic fatigue under the hydrostatic pressure of the liquid being conveyed, to the ship's hull elongations, to the thermal stresses connected with the temperature gradient, and a low coefficient of thermal conductivity. Use is made, for the said insulation, of rigid, high-density polyurethane foams, which are products of macromolecular structure which can be easily injected after some preparation conditions are fulfilled.

A sealing membrane or primary barrier 5 in contact with the liquid being conveyed, which must possess mechanical strength without however imposing two important edge or border stresses, and which must offer an excellent behaviour to cyclic fatigue due to the deformations of the ship. The membrane 5 is of a composite type made up of a metal sheet, foil or strip **5*b* such as an aluminium sheet or foil ensuring the fluid-tightness, which sheet is sandwiched between two layers 5*a*, 5*c* of glass cloth which ensure good mechanical strength. Moreover, the layer 5*c* facilitates the sticking of the member on the insulating material 4**.

As can be noticed in FIG. 1 and according to a preferred form of embodiment, the carrying insulation 4 is actually made up of two portions:

a portion **4*a* obtained by injecting polyurethane foam into moulds in a manner that will be described later in more detail, a second portion constituted by stiffening blocks or elements 4*b* constituted by polyurethane foam, but of a higher density than the polyurethane foam constituting the portion 4*a*** of the insulation, or by any other insulating material offering good shear characteristics, such as plywood.

Indeed, the stresses produced in the sealing membrane or primary barrier 5 by heat shrinkage and the movements of the ship at sea must be transmitted to the double hull or secondary barrier 3 through the insulating wall 4. Now it seems that these stresses are transmitted mainly in proximity to the edges of the tank, so that the stiffening blocks **4*b*** possessing higher rigidity than the rest of the insulating wall are mounted at the dihedral angles of the tank.

Referring again to FIGS. 1 and 2, the first stage of the process of mounting the wall structure according to the invention will now be described in detail.

In the first place, fastening studs are welded on each internal face of the secondary barrier 3 in parallel rows, i.e. a row of longer studs **6*a* uniformly spaced along the perimeter of each face of the tank 2 and intermediate rows of shorter studs 6*b* uniformly spaced within the space defined by the rows of longer studs 6*a*** and aligned with the latter.

When this operation is completed, the mounting is performed, for example, of two rows **7*a*, 7*b* of stiffening blocks 4*b* in longitudinal relationship to the straight edge-line of the dihedral angle defined by the walls 3*a* and 3*b* of the secondary barrier 3. These stiffening blocks of substantially rectangular cross-section and substantially trapizoidal longitudinal section are therefore mounted near the periphery of the adjacent ends of the walls 3*a* and 3*b*, leaving a free space 8 as a passageway between the said walls and the edge of the dihedral angle. The adjacent edges of the two rows of stiffening blocks 7*a* and 7*b* are bevelled, and the continuity of the insulating wall 4 at the dihedral angle is ensured by taper shims of the same dimensions as the space between the bevels 9, which are forced in between the two rows 7*a* and 7*b*** of stiffening blocks just after the operation of mounting the primary barrier.

This operation is repeated for all the edges of the dihedral angles of the tank 2, which amounts to providing a frame on each face of the tank 2.

In fact, in the preferred form of embodiment represented in FIG. 2, use is made, for each row of stiffening blocks, of an alternating series of two types of stiffening blocks **4*b*, 4*b*′, so that the lengths of two adjacent stiffening blocks at the secondary barrier 3 are equal, which means that, since the longitudinal sections are trapezoidal, the length of the larger basis of one of them is equal to the length of the smaller basis of the other so as to form interstices 11** between the successive stiffening blocks which are inclined with respect to a plane perpendicular to the wall on which they are secured, and which, after being filled up with a packing material, ensure a better mechanical bond between the stiffening blocks of a same row than interstices perpendicular to the wall.

These rows of stiffening blocks thus defined are mounted on the secondary barrier 3 through the medium of the longer studs **6*a* in the following manner, referring to FIGS. 1 and 2**.

Each stiffening block **4*b*, 4*b*′ is provided with at least one through hole 47 perpendicular to the longitudinal axis of the stiffening block. The end of the hole 47 opposite to its end facing the secondary barrier 3 is bell-mouthed so as to accommodate a taper plug 12 of plastics material. Each stiffening block 4*b*, 4*b*′ is therefore positioned on the corresponding wall with respect to the longer studs 6*a* whose free ends are engaged into the holes 11 of the stiffening blocks, the length of the studs being smaller than the thickness of the stiffening blocks. The taper plugs 12 engaged into the holes 11 are provided with a central orifice in the shape of a nut 13 which allows the plugs 12 to be screwed on the portions of the studs 6*a* protruding in the bell-mouthed portions of the holes 47. In order that each stiffening block may be reliably fastened on the secondary barrier 3, there is previously provided, in a manner known per se, for example an intermediate layer 14 of a suitable material on the stiffening block surfaces which must be applied on the secondary barrier 3, the said intermediate layer ensuring perfect adherence. Once the stiffening blocks are secured after screwing the plugs 12 the bell-shaped portions of the holes 47 are filled up by means of a packing material 15 before the mounting on the primary barrier 5**.

There will now be described a second important stage of the process, i.e. the in situ injection of the rest of the insulating wall **4*a*** by injecting polyurethane foam into removable moulds secured on the walls of the tank.

Figure 3:
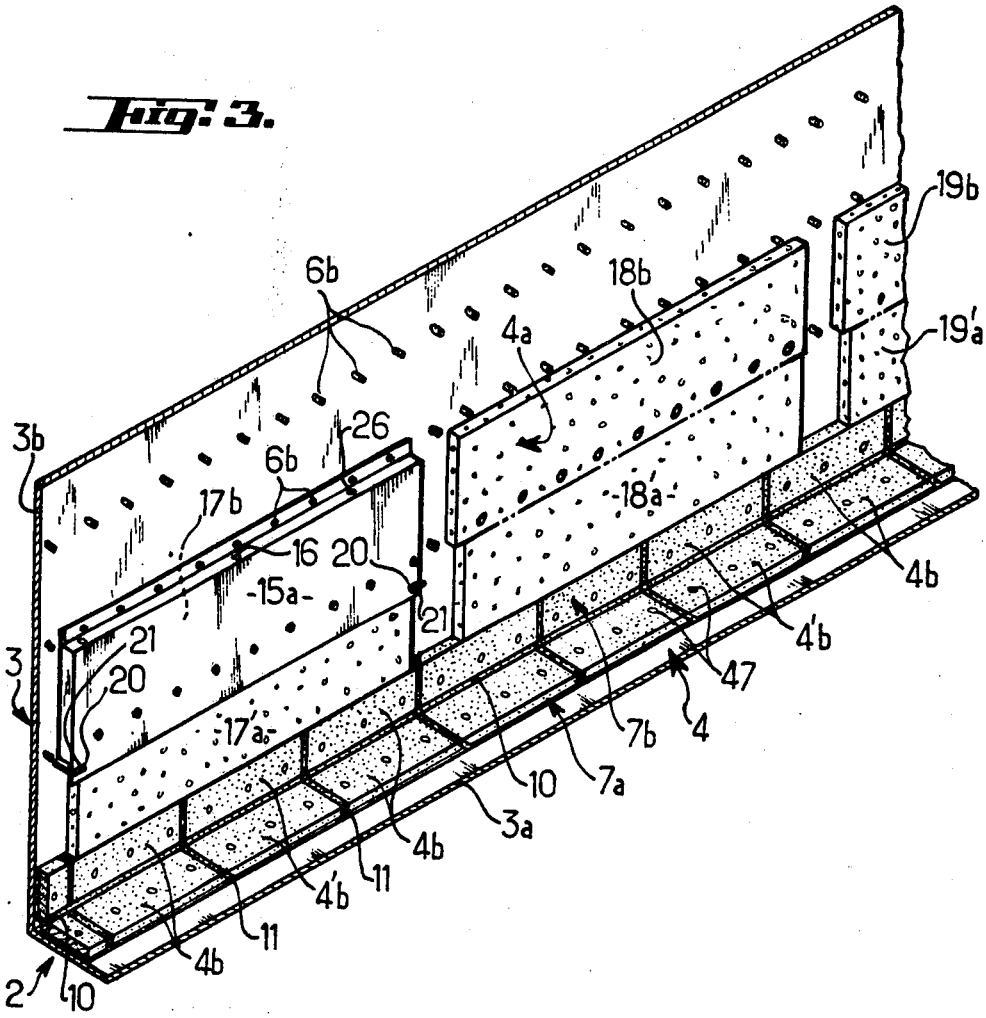
FIG. 3 is a partial perspective view identical with that of FIG. 2, illustrating the second stage of the method of mounting the wall structure.
Figure 4:
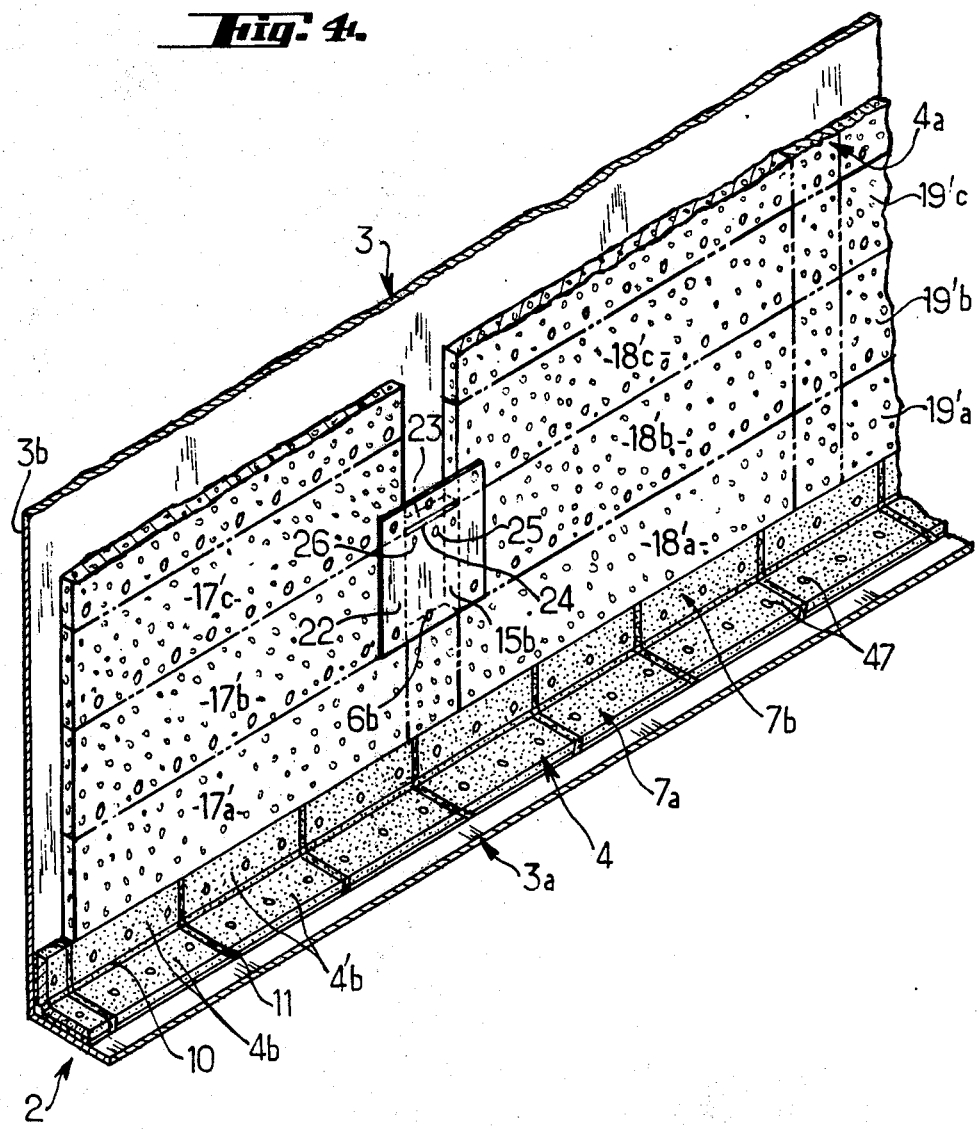
FIG. 4 is a partial perspective view identical with that of FIG. 3, illustrating the third stage of the method of mounting the insulating wall of the wall sturcture according to the invention.

In FIGS. 2 to 4 are illustrated the various stages which allow the portion **4*a* of the insulating wall 4 to be obtained on the vertical face 3*b* of the tank 2**.

The principle of the operation is as follows: through the medium of a first type of mould **15*a* a series of insulating blocks is injected between the framing formed by the stiffening blocks 4b, 4b' of the tank face 3b, starting for example from the lower portion of the tank wall 3b. More precisely, columns of insulating blocks spaced from one another are mounted, the spaces between the columns being thereafter filled up with an insulating material by means of a second type of mould 15b**. The structure of these two types of moulds will be described later.

Referring to FIG. 2, there is shown a mould 15a mounted at the lower portion of the tank wall 3b. The mould 15a rests by one of its sides on the upper surface of the lower stiffening blocks 4b, 4b' so as to ensure the continuity between the portions 4a and 4b of the insulating wall 4. Of course, the other three sides of the mould bear upon the wall 3b. The mould 15a is secured on the one hand on the row of longer studs 6a which have served to secure the stiffening blocks and on the other hand on the first row of shorter studs 6b. After the mould 15a is put in place, high-density polyurethane foam is injected by means of an injection machine (not shown) through an orifice 16 for example at the upper portion of the mould. In this manner, a block of insulating material such as the block 18a is obtained. After the block is injected and the foam is completely polymerized the mould 15a is removed by injecting compressed air into the latter after removing the elements serving to fasten the mould. When the block 18a is thus obtained, a sawing is performed to eliminate the crust corresponding to an overdensification of the foam along the three walls of the block over a thickness of from 5 to 10 cm. A final block 18a' is thus obtained.

After, for example, all the lower blocks 17a', 18a' . . . are obtained, a second series of blocks 17b, 18b is placed above the blocks already formed, which are thereafter cut to obtain the finished blocks 17b', 18b'.

Referring to FIG. 3, there is shown the forming of the blocks 17b adjacent to the blocks 17a'. To this end the same procedure is applied as for the block 17a', the mould 15a being secured on two adjacent rows of shorter studs 6b. However, since the cut block 17a' has a smaller dimension than the block 17b, which means that the mould 15a has greater dimensions than the block 18a', the mould 15a is provided with two slides 20 which ensure on either side and at the upper portion of the already injected block 17a' a connection between the latter and the mould. The slides 20 mounted in perpendicular relationship to the wall 3b are guided on one side in the region of the mould through the medium of a slide guide 21, whereas on the other side, at the moment of their insertion they slightly notch the cut block 17a'. After this block is cast, it is cut to obtain the final block 17b'. The block 18b' adjacent to the block 17b' is formed in the same manner. There is thus provided at the wall 3b of the tank a series of spaced columns of insulating blocks extending from the lower row to the upper row of stiffening blocks of the wall 3b.

Referring to FIG. 4, another stage of the process will now be described, consisting in filling up the spaces between the columns (17a', 17b' . . . ), (18a', 18b' . . . ), through the medium of a second type of mould 15b. The mould 15b is essentially constituted by a plate 22 parallel with the wall 3b and resting upon two adjacent blocks of two adjacent columns and secured on two adjacent rows of smaller studs 6b, and by a slide plate 23 mounted in perpendicular relationship to the wall 3b and engaged into an aperture 24 at the upper portion of the plate 22, thus causing those edges of the slide 23 which are adjacent to the two blocks 17b', 18b', respectively, to slightly notch the latter so as to reliably secure the said slide. After the mould 15b is mounted, polyurethane foam is injected therein through an orifice 25, e.g. in the region of the slide 23. Of course both types of moulds are also provided with vents 26 allowing air to escape from the mould as the injection of polyurethane foam proceeds.

This operation is repeated with the mould 15b in order to fill up all the spaces between the above-mentioned columns and between the end columns and the vertical rows of stiffening blocks of the wall 3b.

It should be noted that the notches made by the moulds at the moment of their fastening are automatically filled up when the adjacent block is cast.

The insulating wall 4 of the face 3b of the tank 2 is thus obtained. The same procedure is followed for all the other faces of the tank.

Referring again to FIG. 1, another stage of the process will now be described, which consists in mounting the primary barrier 5 on the insulating wall 4. The sealing membrane 5 in the form of strips or bands is caused to adhere to the insulation 4 by means of, for example, a thixotropic adhesive substance. As shown in FIG. 7, the fluid-tightness of the primary barrier 5 is obtained by means of butt-straps or joint-plates 30 from the same material as the primary barrier 5. As seen in FIG. 1, the primary barrier 5 overlays not only the portion 4a of the insulating wall but also the stiffening blocks 4b beyond their bevels 9.

After the primary barrier is secured, the continuity of the wall structure 1 in the regions of all the dihedral angles of the tank 2 must be ensured. This continuity is obtained by means of shims 10 which are inserted at each dihedral angle between the two adjacent bevels of the two adjacent rows of stiffening blocks of every two adjacent walls of the tank defining a dihedral angle. The tightly inserted shims 10 extend substantially the full length of the bevels 9. Also the shims are made from polyurethane. Thereafter, in order to perfect the structure of the wall 1 at the dihedral angles of the primary barrier 5, curved joint-straps 31 are placed at each dihedral angle, said curved joint-straps having the same constitution as the primary barrier and extending over the whole or part of the width of the two adjacent rows of stiffening blocks of two adjacent faces. Between the joint-strap 31 and the shim 10 is preferably placed a layer of mastic 32 so as to impart to the primary barrier 5 a substantially uniform curvature at each dihedral angle.

These last operations end the wall structure mounting process according to the invention.

Figure 5:
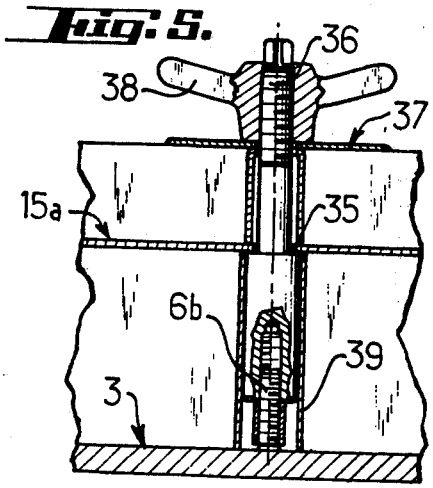
FIG. 5 is a longitudinal sectional view showing the fastening of the moulds for injecting the material constituting a portion of the insulating wall of the wall structure.

Referring to FIG. 5, there is shown a type of fastening of the moulds 15a on the secondary barrier on the row of shorter studs 6b adjacent to the already placed blocks of insulating material. The mould 15a is provided with a hole 35 for the passage of a pin 36 screwed onto the end of the corresponding stud 6b. The mould 15a may be equipped with an upper plate or frame 37 on the upper surface of which bears a nut 38 screwed on the threaded end of the pin 36 projecting beyond the plate 37. In order to fasten the mould it is therefore sufficient to screw the nut 38. In order not to exceed a certain degree of tightening of the mould 15a, a board sleeve 39 is placed around the pin 36 and rests upon the secondary barrier 3. The height of the sleeve 39 corresponds to the height of the insulating block to be injected and its diameter is greater than that of the hole 35 of the mould.

Figure 6:
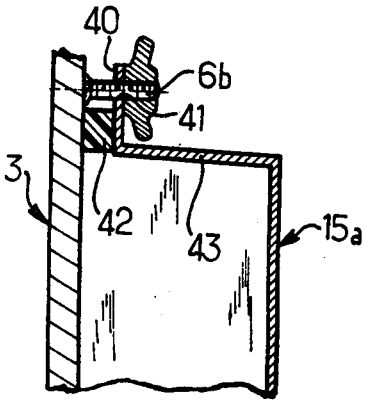
FIG. 6 is a partial cross-sectional view of a mould, showing the sealing shims between the mould and the secondary barrier.

Referring to FIG. 6, there is shown the opposite portion of the mould 15*a* and more particularly the way in which it is fastened on the row of studs 6*b* adjacent to the row of studs 6*b* of FIG. 5. As can be seen, the side of the mould which is parallel with the rows of studs is bent at right angles to form a flange 40 near the end of which are provided holes 41 for the passage of the shorter studs 6*b*. Between the flange 40 and the secondary barrier 3 is mounted a resilient shim 42 of semi-hard foam which is compressed by the mould when the latter is fastened by means of the two adjacent rows of studs 6*b*. The shim 42 ensures good fluid-tightness of the mould. The shim 42 is in fact a continuous band placed on the three end faces of the mould 15*a* in contact with the secondary barrier 3. The band is put in place more easily by previously being adhesively assembled to the mould.

It will also be noted in FIG. 6 that the sides or flanks of the mould form a taper or draft angle 43 which assists the withdrawal of the mould after the injection of foam by means of a jet of compressed air.

Referring to FIG. 7 showing the construction of the primary barrier 5 of the wall structure 1 according to the invention, there is provided at the joints of the said primary barrier a device which, during the mounting of the butt-straps or joint-plates 30, allows any leakage at the said butt-straps to be instantaneously detected. To this end, before adhesively securing the butt-strap, a foraminated or perforated tube 46 is placed in the space defined between two strips or bands of the sealing membrane 5. After the butt-strap is laid, there is injected into the foraminated tube a compressed gas such as for example ammonia, which, if the butt-strap is not perfectly tight, will react on, for example, a coloured tape outside the butt-strap. Such a detection is advantageous since it can be performed as the laying of the butt-straps proceeds.

Referring again to FIG. 1, there is provided an incorporated device allowing to continually check the fluid-tightness of the primary barrier 5 and of the secondary barrier 3 or double hull of the ship. This device is constituted by a system of drain conduits 50 located at the interface between the insulation and the double hull or secondary barrier 3. The system of drain conduits is obtained by arranging pipes 51 of anti-adherent material within the injection moulds 15*a*, 15*b*. After the injection of polyurethane foam to form the portion 4*a* of the insulating wall 4 and after the polymerization of the foam, the pipes 51 are withdrawn. Of course this operation is carried out in the region of the stiffening blocks 4*b*, 4*b*' so that the drain conduits 50 open into the empty spaces 8 of the dihedral angles, which spaces serve as collectors. The system of drain conduits allows poor fluid-tightness of the primary barrier 5 to be detected as a result of possible diffusion of the gas in the insulation.

Referring to FIG. 8, there is shown a partial view illustrating a dihedral angle greater than 90°. The stiffening blocks 4*b* used in this case are the same as in the case of an angle of 90°, which means that the type and shape of the stiffening blocks are independent of the dihedral angle and that only the shape of the shims 10 ensuring the continuity between two adjacent rows of stiffening blocks is different. A question naturally arises as to the use of the two types of moulds. Indeed, it may be asked why a single type of mould of sufficient length may not be used so as to avoid injecting several blocks at one and the same level of a tank wall. This is simply accounted for by the fact that the present injection machines have not sufficient capacity, thus compelling to form the blocks successively.

It may also be noted that in order to assist the adhesion of the polyurethane foam injected into the moulds on the secondary barrier 3, there can be previously applied on the secondary barrier 3, between the rows of studs, strips or bands 52 of a suitable material, e.g. glass cloth, such as the one known as "spun-roving" ensuring better adherence. In the case of blocks injected by means of the first type of mould 15*a*, a sawing is performed to eliminate the crust corresponding to an over-densification of the foam, it being obvious that the sawing is also performed on the only visible side of the blocks injected by means oftthe second type of mould. If it is also desired to ensure better adherence between two adjacent injected blocks, the sawed portions are coated with, for example, an elastomer. Moreover, if it is desired to reliably prevent the polyurethane foam from adhering to the mould walls, the latter can be coated with an anti-adherent material.

The above-described wall structure used in the method according to the invention is therefore advantageously used for built-in, integrated or incorporated tanks for the transportation of liquefied petroleum gases. The fact that the major part of the insulating wall is directly injected onto the second barrier offers many advantages. In particular, it allows a continuous insulating wall to be obtained, which is not the case when use is made of prefabricated insulating panels secured to the secondary barrier. Moreover the means used for mounting the wall structure are simple, thus allowing tanks to be built at substantially lower cost while at the same time obtaining a wall structure perfectly meeting the desired requirements.

Of course, the invention is by no means limited to the form of embodiment which has been given and described by way of example only, but comprises all technical equivalents to the method described as well as their combinations should the latter be carried out according to the gist of the invention and used within the scope of the following claims.

What is claimed is:

1. A method of mounting and assembling a wall structure comprising a rigid outer wall constituted by a ship's double hull forming a secondary barrier, a wall of heat-insulating material such as a rigid polyurethane foam injected directly onto the secondary barrier, and an inner, substantially flexible wall or sealing membrane forming a primary barrier secured on the said insulating wall, for a tank of, for example the built-in, integrated or incorporated type intended to contain, in particular liquefied petroleum gases, wherein it consists:

in securing, for example welding, rows of fastening studs on each internal face of the secondary barrier at predetermined spaced points thereof, in laying between the said rows of studs strips or bands of a material such as glass cloth for improving the adherence of the secondary barrier, in mounting a series of stiffening blocks or elements of a predetermined length in longitudinal relationship to the straight edge line of each dihedral angle of the tank near the ends of the two adjacent internal faces of the tank defining the said dihedral angle, in fastening the said stiffening blocks or elements by means of the said studs and of, for example, a suitable material interposed between the stiffening blocks or elements and the secondary barrier to cause the said stiffening blocks or elements to correctly adhere to the secondary barrier, in injecting within the frame defined by the stiffening blocks or elements at each face of the tank the insulating wall through the medium of moulds over a thickness corresponding substantially to the thickness of the said stiffening blocks or elements, in placing the primary barrier on the insulating wall after the polymerization of the injected polyurethane foam, in ensuring the continuity of the insulating wall between the two rows of stiffening blocks or elements at each dihedral angle by interposing shim elements therebetween, and in applying at least in the region of the shim elements a curved joint-strap embracing each dihedral angle of the tank to ensure continuity between the primary barriers of the two tank faces defining the said dihedral angle.

2. A method according to claim 1, wherein the adjacent edges of the two rows of stiffening blocks or elements extending on either side, respectively, of the angle edge line of each dihedral angle are bevelled through the whole length of the edge of the said dihedral angle, the space between the adjacent bevels of each dihedral angle being filled up with the afore-mentioned shim elements.

3. A method according to claim 2, wherein it consists in prefabricating stiffening blocks or elements of substantially rectangular cross-section and substantially trapezoidal longitudinal section.

4. A method according to claim 3, wherein it consists in rendering the shape and dimensions of the said stiffening blocks or elements independent of the value of the dihedral angles of the tank.

5. A method according to claim 4, wherein it consists, in order to secure the said stiffening blocks or elements on the secondary barrier, in providing at least one hole in each stiffening block or element so as to position the latter through the medium of an aforesaid stud engaged into one of the ends of the said hole, in bell-mouthing or widening-out the other end of the said hole to accommodate therein a plug, e.g. conical in shape, having a threaded central orifice, and in screwing the said plug on the end of the said stud projecting in the bell-mouthed or widened out portion of the said hole.

6. A method according to claim 5, wherein it consists, in order to obtain the aforesaid insulating wall by injecting for example rigid polyurethane foam onto one of the internal faces of the said secondary barrier defined by four rows of said stiffening blocks or elements parallel two by two, in mounting a first type of mould so as to inject a first series of insulating blocks adjacent to one of the rows of stiffening blocks or elements and spaced from one another, in injecting by means of the said moulds a second series of insulating blocks superposed on the previously injected insulating blocks, and so forth, and in successively filling up the spaces between the said series of insulating blocks by means of a second type of mould.

7. A method according to claim 6, wherein it consists in cutting each injected insulating blocks so as to eliminate the crust corresponding to an overdensification of the polyurethane foam along the walls of each insulating block.

8. A method according to claim 6, wherein it consists in securing the aforesaid moulds on the rows of aforesaid studs.

9. A method according to claim 1, wherein it consists in providing a device allowing to permanently check the fluid-tightness of the said primary and secondary barriers, by incorporating a system of drain conduits within the injection moulds and the stiffening blocks or elements by arranging pipes constituted by, for example, an anti-adherent material, and in withdrawing the said pipes after the polymerization of the polyurethane foam.

10. A method according to claim 9, wherein it consists in incorporating the said system of drain conduits at the interface between the said insulating wall and the said secondary barrier.

11. A method according to claim 10, wherein it consists in connecting the system of drain conduits with main collectors provided along each dihedral angle edge of the tank.

12. A method according to claim 1, wherein it consists in providing a device for rapidly detecting the integrity of the said primary barrier in the region of its butt-straps or joint-plates, in introducing a foraminated or perforated tube into the interval separating two strips or bands of the membrane constituting the primary barrier, in applying and securing the butt-strap or joint-plate, and in injecting compressed gas into the said tube in order to detect in a manner known per se the fluid tightness of the said butt-strap or joint-plate.

* * * * *